United States Patent [19]

Brightbill et al.

[11] Patent Number: 4,646,820

[45] Date of Patent: Mar. 3, 1987

[54] APPARATUS FOR PRODUCING A HEATING FLUID

[75] Inventors: Jerry D. Brightbill; Kenneth M. Johnson, both of Norman, Okla.

[73] Assignee: Alco Food Service Equipment Company, Miami, Fla.

[21] Appl. No.: 823,041

[22] Filed: Jan. 27, 1986

[51] Int. Cl.[4] ..... F28F 9/22

[52] U.S. Cl. ..... 165/145; 165/159; 165/162; 165/163

[58] Field of Search ..... 165/159, 162, 163, 145

[56] References Cited

U.S. PATENT DOCUMENTS

| | | | |
|---|---|---|---|
| 2,052,856 | 9/1936 | Truelsen | 165/163 X |
| 2,320,265 | 5/1943 | Clerc | 165/145 X |
| 2,508,247 | 5/1950 | Giauque | 165/145 X |
| 3,139,067 | 6/1964 | Van Den Broek et al. | 165/163 X |

*Primary Examiner*—William R. Cline
*Assistant Examiner*—Richard R. Cole
*Attorney, Agent, or Firm*—William R. Laney

[57] ABSTRACT

A heat exchange apparatus including a generally cylindrical hollow housing having an upper end and a lower end, and a heating device disposed in the lower portion of the housing. A heating coil assembly is disposed within the housing over the heating device, and includes a radially inner coil bank and a radially outer coil bank adjacent the inner wall of the housing. An intermediate coil bank is connected between the inner and outer coil bank and includes a plurality of helical convolutions of increasing diameter as they successively occur in an axial direction from the lower end of the housing toward the upper end thereof. A baffle frame assembly interconnects and spacially orients the inner and intermediate coil banks, and radially outwardly deflects heated gases from the heating device.

5 Claims, 5 Drawing Figures

APPARATUS FOR PRODUCING A HEATING FLUID

FIELD OF THE INVENTION

This invention relates to heat exchange devices, and more particularly, but not by way of limitation, to an improved heat exchange apparatus for producing steam.

BACKGROUND OF THE INVENTION

Brief Description of Prior Art

An apparatus which produces a heated fluid by passing the fluid through a series of concentric convolutions of a coil, and providing a heater device at the bottom of these coils, is described in U.S. Pat. No. 3,811,414 to Minton. In the Minton heat exchange structure, a burner assembly is provided immediately beneath the lower central portion of a series of convoluted, concentrically arranged heat exchange coils. The fluid to be heated is charged from an entrance or charging point to the coil assembly, and through the coil assembly and to an outer steam nozzle. The coil assembly includes an outer helically wound coil, and an inner helically wound coil which is disposed radially inwardly from the outer coil. The convolutions of the inner and outer coils are radially separated so that the fluid which is passed therethrough purposes of heating is maintained at a relatively low temperature within the outer coil as compared to the temperature within the inner coil. This facilitates insulation of the coil assembly, and denhances the heat transfer efficiency of the heat exchange apparatus thus provided. The coil assembly is enclosed within a double-walled cylindrically shaped housing.

BRIEF DESCRIPTION OF THE PRESENT INVENTION

The present invention provides a heat exchange device which more efficiently heats a fluid passed through a helically turned heat exchange coil which is arranged in three banks, and is used in conjunction with an improved, novel baffle frame assembly to more evenly distribute the hot gasses from a combustion element to several banks of the helically convoluted heating coil assembly.

Broadly described, the present invention comprises an extenal, generally cylindrical hollow insulating housing having an open upper end and a lower end. A heater means, preferably a gas burner, is disposed adjacent the lower end of the insulating housing in a position to direct heat along the central axis thereof. A heating coil assembly is disposed within the insulating housing and includes a radially outer tubular coil bank of helical convolutions of substantially uniformed diameter, and a radially inner tubular coil bank of helical convolutions of substantially uniformed diameter spaced radially inwardly from the radially outer coil bank. An intermediate tubular coil bank of helically coiled convolutions is disposed between, and is interconnected in series to, the outer and inner coil banks. The intermediate coil bank includes a series of interconnected annular convolutions which increase in diameter as the convolutions are encountered in an axial direction along this coil bank from the upper to the lower end thereof.

A baffle frame assembly interconnects the inner and intermediate tubular coil banks and deflects heated air radially outwardly to more efficiently heat the several coil banks.

An important object of the present invention is to provide a multiple bank heat exchange coil through which a fluid to be heated is moved, and in which the banks of the coil are arranged so that the radially interior banks can be easily removed from the external or radially outer coil bank in order to replace portions of the coil, or to facilitate repairing internal portions of the coil.

Another object of the invention is to provide a heat exchange apparatus by which a fluid can be heated in a more efficient fashion as it passes through a convoluted coil.

Another object of the invention is to provide a helically coiled tubular heat exchange element which is used in a heat exchanger and is arranged so as to more efficiently, in conjunction with a novel baffle assembly which is provided, heat a fluid passed through the coil.

A further object of the invention is to provide a heat exchange apparatus which includes concentric banks of helically turned tubing, which heat exchange apparatus is ruggedly constructed and has a long and trouble free operating life.

Additional objects and advantages of the invention will become apparent as the following detailed description of the invention is read in conjunction with the accompanying drawings which illustrate a preferred embodiment of the invention.

DETAILED DESCRIPTION OF A PREFERRED EMBODIMENT OF THE INVENTION

Figure 1:
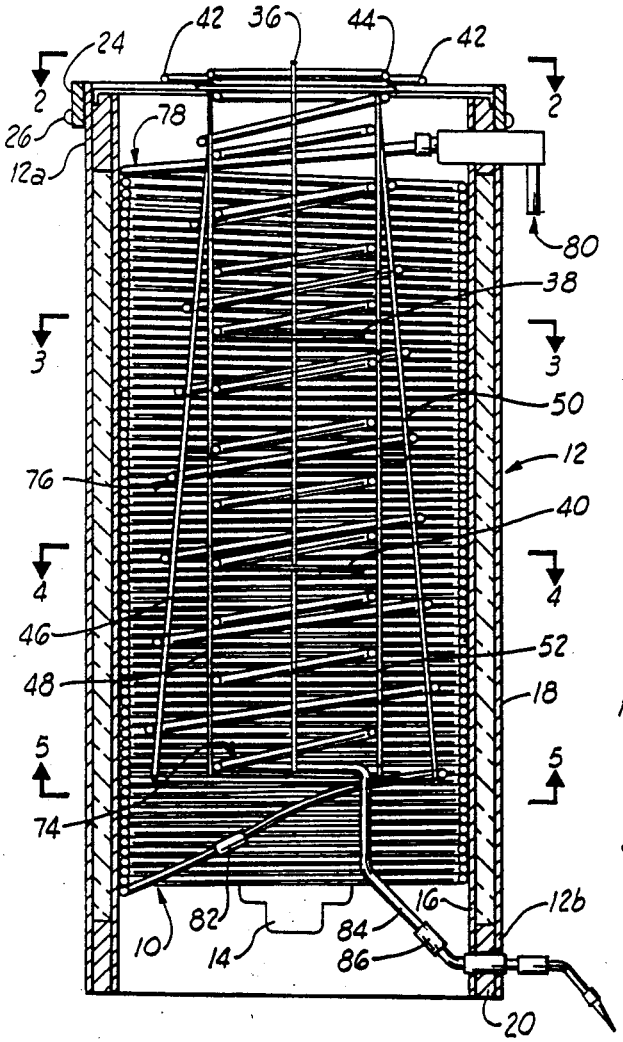
FIG. 1 is a view of the heat exchange apparatus of the invention, showing in vertical sectional view, the insulating housing and the coiled tubular element constituting the heating coil assembly disposed within the insulating housing. A baffle frame assembly utilized in the invention is illustrated in side elevation.

Referring to the drawings, the coil assembly forming a part of the invention is designated generally by reference numeral 10, and a housing in which the coil assembly is disposed for purposes of insulation during operation is designated generally by reference numeral 12. The housing 12 has an upper end portion **12*a* and a lower end portion 12*b*. A burner assembly 14 is disposed within the housing 12 adjacent the lower portion of the coil assembly as illustrated in FIG. 1**.

The heat exchange apparatus of the invention, as illustrated in FIG. 1, can be mounted upon a cart or other mobile support platform (not shown). One type of mobile support which can be used to carry the heat exchange apparatus, as well as a source of fuel, electrical circuitry, and other parts associated with the heat exchange apparatus, is illustrated in Minton U.S. Pat. No. 3,881,414, and the disclosure of that particular patent, as it relates to mobile support 12 there illustrated and described, is incorporated herein by reference.

Although the heat exchange apparatus of the invention is generally useful for heating a variety of fluids, it is particularly adapted for producing steam utilized for cleaning purposes, and a portion of the following discussion will be directed to that particular utility of the apparatus.

The enclosure or housing 12 within which the tubular coil assembly 10 is located includes a pair of concentric metallic walls 16 and 18 between which is located a material 20 having a low thermal conductivity, and thus functioning for insulation of the interior of the housing, and for reduction of heat transfer across the housing.

A baffle frame assembly is designated generally by reference numeral 22. The baffle frame assembly includes an annular support strap 24 which fits closely around the outer periphery of the upper end portion 12*a* of the housing. The support strap 24 is secured to the upper end portion of the housing 12 by a plurality of screws 26 or other fastening devices.

Connected across and within the annular support strap 24 is a coil frame and baffle supporting spider. The spider includes a pair of crossed, diametric horizontal braces 30 and 32 which are secured to a baffle rod suspension plate 34 at a central position within the spider. An elongated rigid baffle rod 36 projects downwardly from the baffle rod suspension plate axially within the housing 12. The baffle rod 36 functions to support a pair of axially spaced, disc shaped baffle plates 38 and 40 which extend in spaced horizontal planes normal to the baffle rod 36, and transversely across the common axis of the three coil banks forming subassemblies of the heat exchange coil assembly 10 as hereinafter described.

Figure 2:
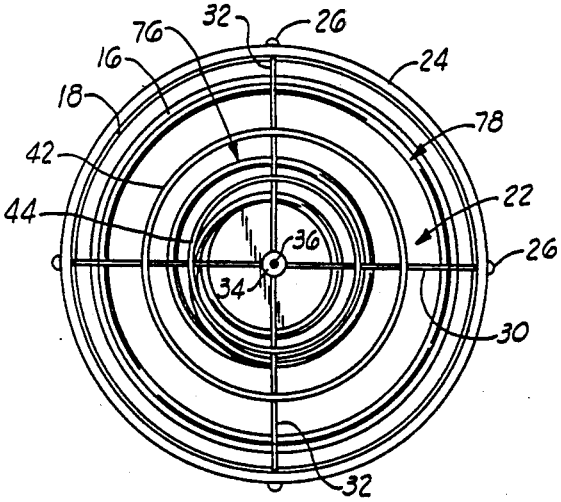
FIG. 2 is a sectional view taken along line 2—2 of FIG. 1.

In addition to the crossed diametric horizontal braces 30 and 32, the spider further includes a pair of concentric circular rods 42 and 44 which are supported by, and welded to, the horizontal braces 30 and 32 in the manner illustrated in FIG. 2.

At the four points where the radially intermost circular concentric rod 44 is welded or otherwise suitably secured to the diametric horizontal braces 30 and 32, four pairs of coil spacing frame rods project downwardly within the housing 12. The four pairs of coil spacing frame rods include the rod pairs 46, 48 and 50, 52 depicted in FIG. 1. The rod pair 54, 56 and the rod pair 58, 60 can be perceived in cross section in FIGS. 3, 4 and 5. It can be observed in FIG. 1 that the rods in each of the rod pairs diverge from a substantially common point of securement to the respective horizontal brace 30 or 32 and to the circular concentric rod 44 at a location adjacent the top of the heat exchange apparatus.

Figure 5:
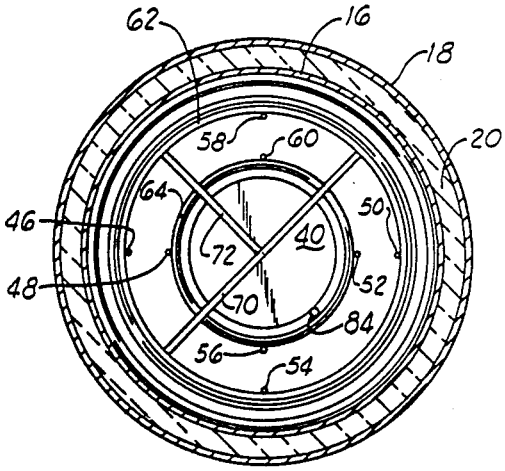
FIG. 5 is a sectional view taken along line 5—5 of FIG. 1.

At the lower ends of the outermost rods in the coil spacing frame rod pairs, these rods, denominated by reference numerals 46, 50, 54 and 58 are secured to, and support, a radially outer lower ring rod 62 of circular configuration. The lower ring rod 62 is spaced radially outwardly from a concentrically disposed inner ring rod 64. The ring rod 64 is secured to, and supported by, the lower ends of the four coil spacing frame rods 48, 52, 56 and 60 located radially inwardly in each of the coil spacing frame rod pairs. An inner coil bank diametric supporting rod 70 extends transversely across the lower portion of the housing 12 in substantially a common plane with the ring rods 62 and 64 as shown in FIG. 5. A radial rod 72 extends normal to the diametric support rod 70 along a radius of the ring rod 62, and provides further support for the inner coil bank of the coil assembly as hereinafter described.

The function of the baffle frame assembly 22 is to support, and spacially orient, certain portions of the coil assembly 10 with respect to each other, and with respect to the housing 12 and burner assembly 14. The portions of the coil assembly which are thus supported and spacially oriented by the baffle frame assembly 22 include a radially inner tubular coil bank 74, and an intermediate tubular coil bank 76 which, in general, is spaced radially outwardly from the radially inner tubular coil bank. The radially inner coil bank 74 and the intermediate tubular coil bank 76, together with a radially outer coil bank 78, when all are interconnected, make up the coil assembly 10 best illustrated in FIG. 1 of the drawings. The radially outer coil bank 78 fits tightly within the metallic inner wall 18 of the housing 12, and is retained therein by tight frictional engagement. The frictional retention of the radially outer coil bank 78 is enhanced by this coil bank being resiliently deformed radially inwardly slightly so as to continuously exert an outwardly acting force against the inner wall 18 of the housing. The entrance or charging location for charging a fluid to be heated is an inlet location denominated by reference numeral 80 in FIG. 1 of the drawings. It will be perceived that the fluid to be heated is initially charged to the uppermost convolution of the radially outer coil bank 78. The radially outer coil bank 78 is connected at its lower end to the intermediate tubular coil bank 76 through a detachable coupling or fitting 82 (see FIG. 1).

In referring to FIG. 1, it will be noted that although the radially inner coil bank 74 and the radially outer coil bank 78 are made up of helical convolutions of substantially equal diameter, the intermediate tubular coil bank 76 is made up of a series of helical convolutions which are of decreasing diametric dimension as they occur repeatedly in an axial direction, from the bottom of the heat exchange apparatus upwardly therein. Thus, the largest diameter convolutions of the intermediate tubular coil bank 76 are those which are located nearest the bottom of the heat exchange apparatus, whereas the convolutions of relatively smaller diameter are located toward the top of the heat exchange apparatus. This configuration of the coils of the intermediate tubular coil bank (a substantially frustoconical overall configuration) is retained during operation of the heat exchange apparatus by the outermost four coil spacing frame rods in the four pairs of these rods which are provided. The manner in which these outermost coil spacing frame rods diverge from the radially inner frame rods in each of the rod pairs has been previously explained. It can be perceived in referring to FIG. 1 that the divergence of the two rods in each of the several pairs of coil spacing frame rods creates the spacing interval of axially increasing augmentation which characterizes the relationship between the radially inner coil bank 74 and the intermediate coil bank 76.

The tubular elements of which the coil banks are constructed are preferably copper, and in a preferred embodiment, the copper used in the radially outer coil has a thickness of from about 0.028 to about 0.036 inch, whereas the internal and intermediate coils are made of copper having a thickness of from about 0.038 inch to about 0.046 inch. This construction enables the coil assembly to better withstand shock and torque forces which result when, during operation, the discharging heated fluid is suddenly shut off.

Figure 3:
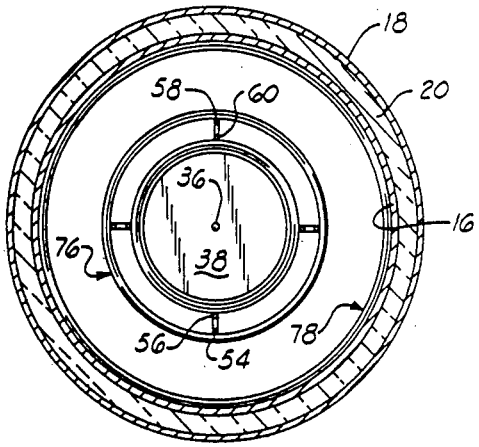
FIG. 3 is a sectional view taken along line 3—3 of FIG. 1.
Figure 4:
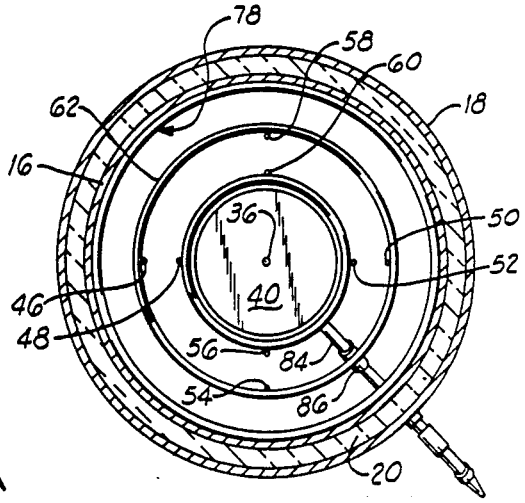
FIG. 4 is a sectional view taken along line 4—4 of FIG. 1.

At the upper end of the heat exchange apparatus, the intermediate tubular coil bank 76 is joined to the upper end of the radially inner coil bank 74 so that fluid from the intermediate bank passes into the inner bank and commences to flow downwardly through the convolutions thereof in a generally axial direction. It will be noted that the baffle plates 38 and 40 are disposed at locations spaced approximately equal thirds of the way along the axial length of the intermediate coil bank 76, and of the radially inner coil bank 74. It will also be noted that these baffle plates have a diameter which is substantially equivalent to the inner diameter of the radially inner coil bank 74, as shown in FIGS. 3 and 4.

At its lower end, the radially inner coil bank 74 is supported upon that portion of the baffle frame assembly 22 which includes the inner coil diametric supporting rod 70 and the radial rod 72. Support is provided at this location by the lowermost circular helical convolution of the radially inner coil bank 74 resting upon the diametric supporting rod 70 and the radial rod 72. It will be noted that the upperside of the burner assembly 14 is closely adjacent to the lower end of the radially inner coil bank 74, and that the burner assembly is positioned for directing hot gases of combustion upwardly along the interior of the radially inner coil bank 74.

The lowermost portion 84 of the tubular conduit of the radially inner coil bank 74 is bent downwardly so that this coil bank can be connected through a suitable quick disconnect coupling 86 to a device or subassembly which will utilize the heated fluid which has been developed within the heat exhchange apparatus. In a typical usage, a steam jetting nozzle (not shown) can be connected to the radially inner coil bank 74 downstream from the coupling 86 and used to provide steam for cleaning or other utilization.

OPERATION

In the operation of the heat exchange apparatus of the invention, a fluid to be heated in the aparatus is introduced to the coil assembly by way of the inlet 80. By this means, the fluid to be heated is charged to the radially outer helical coil bank 78. This coil bank is disposed immediately adjacent the internal wall 18 of the housing 12. Since the relatively cool fluid which is to be heated flows initially through this coil, its location adjacent the insulated double-walled housing 12 assures that the outside of this housing will stay sufficiently cool to permit it to be touched and handled. After the fluid to be heated has traversed the entire length of the radially outer coil bank 78, it passes into the intemediate tubular coil bank 76 and commences to flow upwardly through the helical convolutions of this portion of the coil assembly 10.

By reason of the radially diminishing diameter of successive coils of this intermediate coil bank, the upper convolutions of this coil bank are more completely exposed to hot combustion gases rising upwardly within the housing from the burner assembly 14. Thus, by the time fluid to be heated has reached the uppermost convolution of the intermediate tubular coil bank 76, the fluid has become relatively hot. At this point, the fluid enters the upper end of the radially inner coil bank 74 and commences to flow downwardly therein. In moving downwardly in the radially inner coil bank 74, the fluid is exposed most immediately to the hottest combustion gases moving upwardly from the burner assembly 14. The baffle plates 38 and 40 cause a deflection of hot combustion gases radially outwardly within the housing 12. The radially outward deflection of the hot combustion gases aids in heating both the intermediate tubular coil bank 76, and the radially outer coil bank 78, and provides a more uniform and even distribution of the thermal gradients throughtout the interior of the housing 12. At the lower end of the radially inner coil bank 74, the highly heated fluid is descharged through the detachable coupling or fitting 86 to an external nozzle or suitable point of discharge.

It will be noted that the baffle frame assembly 22 functions to support the radially inner and the intermediate coil banks, 74 and 76, respectively, within the housing 10. The baffle frame assembly 22 also functions, by reason of the divergency of the coil spacing frame rods in each downwardly extending pair of these rods, to achieve the axially diminishing diametric dimension of the several spaced-apart coils of the radially inner coil bank 74. This particular geometry of the intermediate coil bank, coupled with the specific location of the circular or disc-shaped baffle plates 38 and 40, assures that the fluid moving through the intermediate coil bank will be highly heated.

An important feature of the present invention is the ability to quickly and easily remove the radially inner coil bank 74 and intermediate tubular coil bank 76 from the interior of the housing 10, either for replacement or for repair. This is accomplished by quickly disconnecting the couplings 82 and 86. The radially inner coil bank 74 is thereby detached from the fitting which extends through the walls of the housing 12 to the outside thereof for discharging the heated fluid, and also from the radially outer coil bank 78. When these couplings have been disconnected, and the four screws 26 by which the annular support strap 24 is secured to the housing 12 have been removed, the radially inner coil bank 74 and the intermediate coil bank 76 can be removed from the interior of the housing simply by grasping the spider 28 and lifting them upwardly to effect such removal. They can then be replaced by securing new intermediate and radially inner coil banks 76 and 74 to the baffle frame assembly 22, and lowering them into position within the housing 12, and then coupling them to the remainder of the coil assembly 10. Alternatively, the coil banks which have been removed in the manner described can be worked on or repaired, and then returned to the interior of the housing. The ability to quickly and easily remove both the radially inner coil bank 74 and the intermediate coil bank 76 also facilitates the opening up of the interior of the housing so that a pin hole leak or other structural malfunction occurring in the interior of the radially outer coil bank 78 can be gotten at and repaired. As has previously been explained, the radially outer coil bank 78 remains in position within the interior of the housing 10 by reason of the frictional engagement of the radially outer coil bank with this housing.

The heat exchange apparatus of the present invention is highly efficient in operation, and is characterized by having a long and trouble free operating life. Although one preferred embodiment of the invention has been herein illustrated and described in order to enable those skilled in the art to appreciate the principles on which the invention is based, it will be understood that various changes and innovations can be made in the illustrated and described structure without departure from these principles. It is therefore intended that the spirit and scope of this invention be limited only by the broadest reasonable and justified interpretation of the claims which are appended hereto, and which define the invention.

What the claim is:

1. A heat exchange apparatus which comprises:

an external, generally cylindrical hollow insulating housing having an upper end and a lower end;

heater means disposed adjacent the lower end of said housing in a position to direct heat along the central axis thereof; and a heating coil assembly having an upper end and a lower end and disposed within said insulating housing and including:

a radially outer tubular coil bank including helical convolutions of substantially uniform diameter frictionally engaging the inner wall of said generally cylindrical housing;

a radially inner tubular coil bank of helical convolutions of substantially uniform diameter spaced radially inwardly from said radially outer coil bank and disposed above said heater means; and an intermediate tubular coil bank of helical convolutions disposed between, and interconnected to, said radially outer and said radially inner coil banks, said intermediate coil bank including a series of interconnected annular convolutions of axially increasing diameter from the upper end of said intermediate coil bank to the lower end thereof; and a baffle frame assembly supported adjacent the upper end of said housing and supporting said intermediate and inner tubular coil banks and positioned for deflecting heated air radially outwardly with respect to the central axis of said housing to more efficiently heat the several convolutions in said heating coil assembly.

2. A heat exchange apparatus as defined in claim 1 wherein said baffle frame assembly comprises:

an annular support strap secured to said housing around the upper end thereof;

a spider connected to, and mounted within, said support strap and disposed over the upper end of said heating coil assembly;

a plurality of pairs of coil spacing frame rods having ends connected to said spider and extending downwardly in the housing, each of said pairs including a radially inner frame rod and a radially outer frame rod diverging from said radially inner frame rod in a downward direction, said outer frame rods of said pairs extending along the inner sides of the coil convolutions in said intermediate coil bank to establish the increasing diameter of the coils of said intermediate coil bank in an axial direction;

a baffle rod projecting from the center of said spider coaxially downwardly within said housing; and a pair of axially spaced, horizontally extending baffle plates secured to said baffle rod at a location spaced upwardly in said housing above said heater means.

3. A heat exchange apparatus as defined in claim 2 wherein said baffle frame assembly further includes:

a horizontally extending radially outer lower ring rod of substantially circular configuration secured to the lower ends of said outer frame rods;

an inner ring rod disposed radially inwardly from said radially outer lower ring rod secured to the lower ends of said inner frame rods; and supporting rods connected to said outer lower ring rod and functioning to support said inner coil bank.

4. A heat exchange apparatus as defined in claim 1 wherein said outer coil bank is detacheably coupled to said intermediate coil bank at a location spaced radially inwardly from the said radially outer coil bank, and wherein said inner coil bank is detacheably coupled to said housing at a location spaced radially inwardly from said radially outer coil bank thereby facilitating the removal from said housing with said baffle frame assembly of said intermediate and inner coil banks after decoupling them from the outer coil bank and said housing, respectively.

5. A heat exchange apparatus as defined in claim 4 wherein said baffle frame assembly comprises:

an annular support strap secured to said housing around the upper end thereof;

a spider connected to, and mounted within, said support strap and disposed over the upper end of said heating coil assmebly;

a plurality of pairs of coil spacing frame rods having ends connected to said spider and extending downwardly in the housing, each of said pairs including a radially inner frame rod and a radially outer frame rod diverging from said radially inner frame rod in a downward direction, said outer frame rods of said pairs extending along the inner sides of the coil convolutions in said intermediate coil bank to establish the increasing diameter of the coils of said intermediate coil bank in an axial direction;

a baffle rod projecting from the center of said spider coaxially downwardly within said housing; and a pair of axially spaced, horizontally extending baffle plates secured to said baffle rod at a location spaced upwardly in said housing above said heater means.

* * * * *